US007667402B2

(12) United States Patent
Lee

(10) Patent No.: US 7,667,402 B2
(45) Date of Patent: Feb. 23, 2010

(54) PLASMA DISPLAY PANEL AND METHOD OF FABRICATING THE SAME

(75) Inventor: Tae-Ho Lee, Yongin-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 279 days.

(21) Appl. No.: 11/602,198

(22) Filed: Nov. 21, 2006

(65) Prior Publication Data

US 2007/0114930 A1 May 24, 2007

(30) Foreign Application Priority Data

Nov. 23, 2005 (KR) ..... 10-2005-0112217

(51) Int. Cl.
*H01J 17/49* (2006.01)

(52) U.S. Cl. ..... 313/582

(58) Field of Classification Search ..... 313/582–587, 313/490

See application file for complete search history.

(56) References Cited

U.S. PATENT DOCUMENTS

| | | | | |
|---|---|---|---|---|
| 6,043,604 | A | 3/2000 | Horiuchi et al. | |
| 6,194,826 | B1 * | 2/2001 | Satou et al. | 313/485 |
| 6,498,593 | B1 | 12/2002 | Fujimoto et al. | |
| 6,608,441 | B2 * | 8/2003 | Kunii et al. | 313/584 |
| 6,815,890 | B2 * | 11/2004 | Tsai et al. | 313/584 |
| 7,050,021 | B2 | 5/2006 | Hashimoto | |
| 2005/0046350 | A1 * | 3/2005 | Su et al. | 313/582 |
| 2005/0242725 | A1 * | 11/2005 | Hasegawa et al. | 313/582 |
| 2006/0267497 | A1 * | 11/2006 | Yim | 313/581 |

FOREIGN PATENT DOCUMENTS

| | | | |
|---|---|---|---|
| JP | 02-066838 | | 3/1990 |
| JP | 03-084831 | A | 4/1991 |
| JP | 10-106443 | A | 4/1998 |
| JP | 11-306990 | A | 11/1999 |
| JP | 2000-311615 | A | 11/2000 |
| JP | 2001-290462 | | 10/2001 |
| JP | 2002-251165 | A | 9/2002 |
| JP | 2004-179162 | A | 6/2004 |

* cited by examiner

*Primary Examiner*—Toan Ton
*Assistant Examiner*—Hana A Sanei
(74) *Attorney, Agent, or Firm*—Lee & Morse, P.C.

(57) ABSTRACT

A plasma display panel that includes a front substrate, a rear substrate positioned in parallel to the front substrate, a plurality of address electrodes between the front and rear substrates, a plurality of display electrodes positioned perpendicularly to the plurality of address electrodes, and a plurality of barrier ribs between the front and rear substrates, the barrier ribs defining a plurality of discharge cells, and wherein each barrier rib includes at least one longitudinal portion positioned at an obtuse angle with respect to the rear substrate.

18 Claims, 7 Drawing Sheets

PLASMA DISPLAY PANEL AND METHOD OF FABRICATING THE SAME

BACKGROUND OF THE INVENTION

1. Field of the Invention

The present invention relates to a plasma display panel. More particularly, the present invention relates to a plasma display panel having improved structure of discharge cells.

2. Description of the Related Art

In general, a plasma display panel (PDP) refers to a flat display device capable of displaying images using gas discharge phenomenon, thereby providing superior display characteristic, such as high brightness and contrast, lack of residual image, and wide viewing angles.

The conventional PDP may include two substrates with a plurality of discharging electrodes therebetween, i.e., a first substrate having a plurality of pairs of scan and sustain electrodes and a second substrate having a plurality of address electrodes, a plurality of pixel units having phosphorescent layers, and barrier ribs between the two substrates to separate the plurality of phosphorescent layers. When a predetermined amount of electricity is applied to the electrodes, a sustain discharge may be generated to trigger ultraviolet (UV) emission and, thereby, to excite the phosphorescent layers to emit visible light and form images.

More specifically, the barrier ribs of the conventional PDP may define discharge cells therebetween, such that each discharge cell may be formed between a sustain electrode and a scan electrode. Each discharge cell may be coated with a phosphorescent layer emitting red, green, or blue light, such that three adjacent discharge cells having three different colors may form one pixel unit. Accordingly, a matrix of pixel units may be formed between the plurality of address electrodes and the plurality of pairs of sustain and scan electrodes, i.e., between the two substrates, such that one address electrode may overlap with one discharge cell of a pixel unit. The arrangement and structure of pixel units may improve resolution in a PDP. Accordingly, attempts have been made to increase the pixel unit density.

However, increase of pixel unit density may increase the number of required address electrodes in a PDP. An increased number of address electrodes may reduce the distance therebetween and, therefore, increase the capacitance and the power consumption. Additionally, increase of pixel unit density may affect the geometric shape of each discharge cell, e.g., reduce the volumetric capacity of each discharge cell, thereby reducing the deposition area of each phosphorescent layer and, subsequently, deteriorating color tone and luminance of the PDP.

Accordingly, there exists a need to improve the structure of the PDP in order to provide improved pixel unit density, while maintaining a low power consumption and high luminance efficiency.

SUMMARY OF THE INVENTION

The present invention is therefore directed to a plasma display panel which substantially overcomes one or more of the disadvantages of the related art.

It is therefore a feature of an embodiment of the present invention to provide a plasma display panel capable of providing increased pixel unit density, while reducing the number of address electrodes.

It is another feature of an embodiment of the present invention to provide a plasma display panel capable of providing increased pixel unit density, while maintaining low power consumption and high luminance efficiency.

It is yet another feature of an embodiment of the present invention to provide a plasma display panel capable of providing increased pixel unit density, while maintaining sufficient deposition area for phosphorescent layers in each discharge cell.

At least one of the above and other features and advantages of the present invention may be realized by providing a plasma display panel, including a front substrate, a rear substrate positioned in parallel to the front substrate, a plurality of address electrodes between the front and rear substrates, a plurality of display electrodes positioned perpendicularly to the plurality of address electrodes, and a plurality of barrier ribs between the front and rear substrates, such that the barrier ribs may define a plurality of discharge cells, and wherein each barrier rib may include at least one longitudinal portion positioned at an obtuse angle with respect to the rear substrate. The display electrodes may include pairs of scan and sustain electrodes, such that a ratio of the address to scan electrodes may be about 8:3.

The plurality of barrier ribs may be positioned in a direction parallel to a direction of the plurality of address electrodes. Each three discharge cells of the plurality of discharge cells may form one pixel unit. The discharge cells may be arranged in a triangular shape. Two of the three discharge cells may be adjacent to one another along a direction parallel to the direction of the address electrodes. Additionally, the two adjacent discharge cells may overlap with one common address electrode. Further, an extension line of a boundary between the two adjacent discharge cells may pass a center of a third discharge cell of the three discharge cells.

Alternatively, the plurality of barrier ribs may be positioned in a direction perpendicular to a direction of the plurality of address electrodes. Each three discharge cells of the plurality of discharge cells may be arranged in a triangular shape to form one pixel unit, and two of the three discharge cells may be adjacent to one another along a direction parallel to the direction of the barrier ribs. Each pixel unit may be positioned to form a color array, wherein each color array may overlap with one address electrode.

Each discharge cell of the three discharge cells may emit a different color of light. Additionally, each discharge cell may have a first top width and a first bottom width, the first top width being greater than the first bottom width. Further, each discharge cell may have a second top width and a second bottom width, the second top width being smaller than the second bottom width. Each discharge cell may have a hexagonal plane shape.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF THE INVENTION

Figure 1:
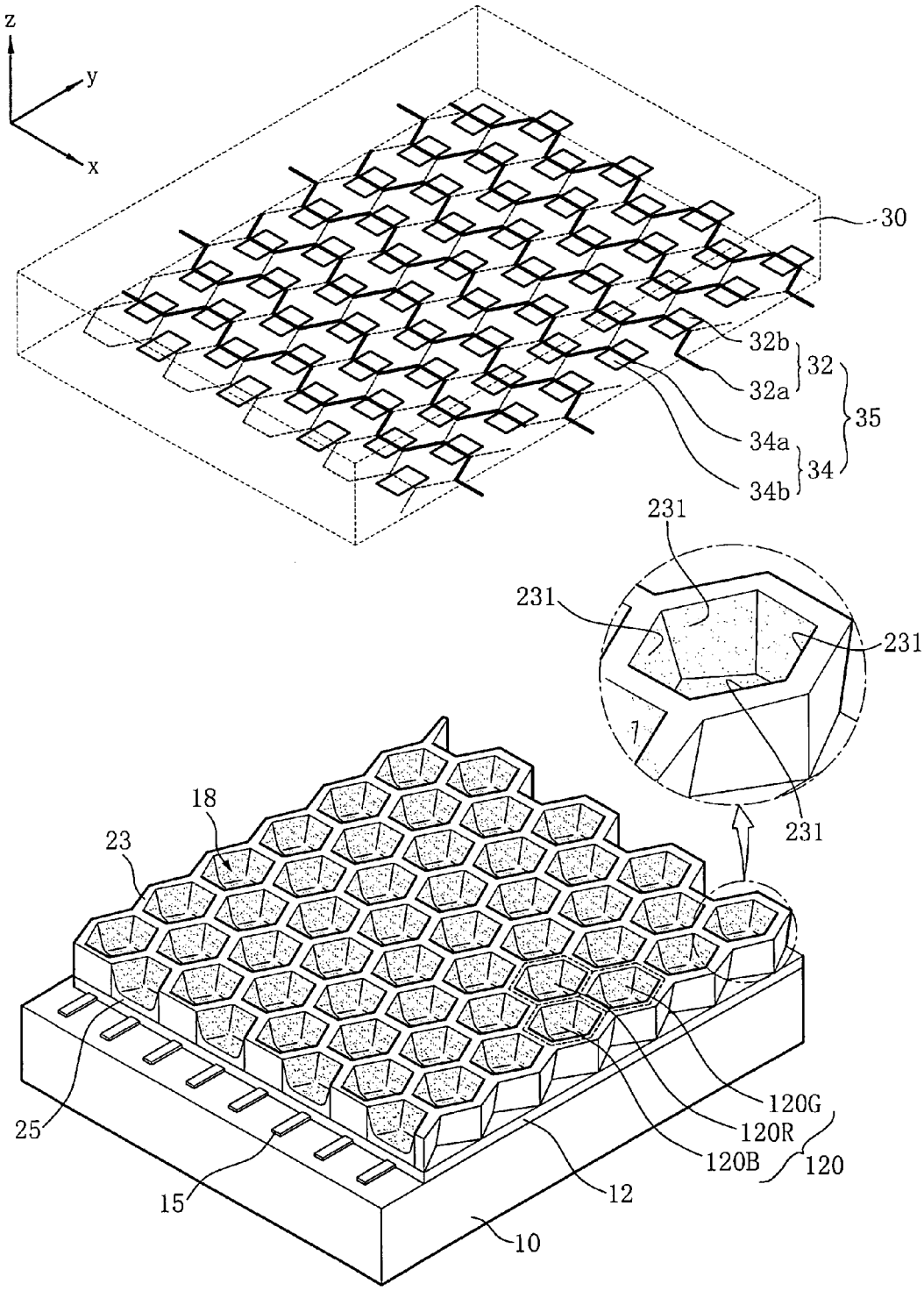
FIG. 1 illustrates a partial exploded perspective view of a plasma display panel (PDP) according to an embodiment of the present invention.

Korean Patent Application No. 10-2005-0112217 filed on Nov. 23, 2005 in the Korean Intellectual Property Office, and entitled: "Plasma Display Panel and Method of Fabricating the Same," is incorporated by reference herein in its entirety.

The present invention will now be described more fully hereinafter with reference to the accompanying drawings, in which exemplary embodiments of the invention are illustrated. The invention may, however, be embodied in different forms and should not be construed as limited to the embodiments set forth herein. Rather, these embodiments are provided so that this disclosure will be thorough and complete, and will fully convey the scope of the invention to those skilled in the art.

It will further be understood that when an element is referred to as being "on" another element or substrate, it can be directly on the other element or substrate, or intervening elements may also be present. Further, it will be understood that when an element is referred to as being "under" another element, it can be directly under, or one or more intervening elements may also be present. In addition, it will also be understood that when an element is referred to as being "between" two elements, it can be the only element between the two elements, or one or more intervening elements may also be present. Like reference numerals refer to like elements throughout.

Figure 2:
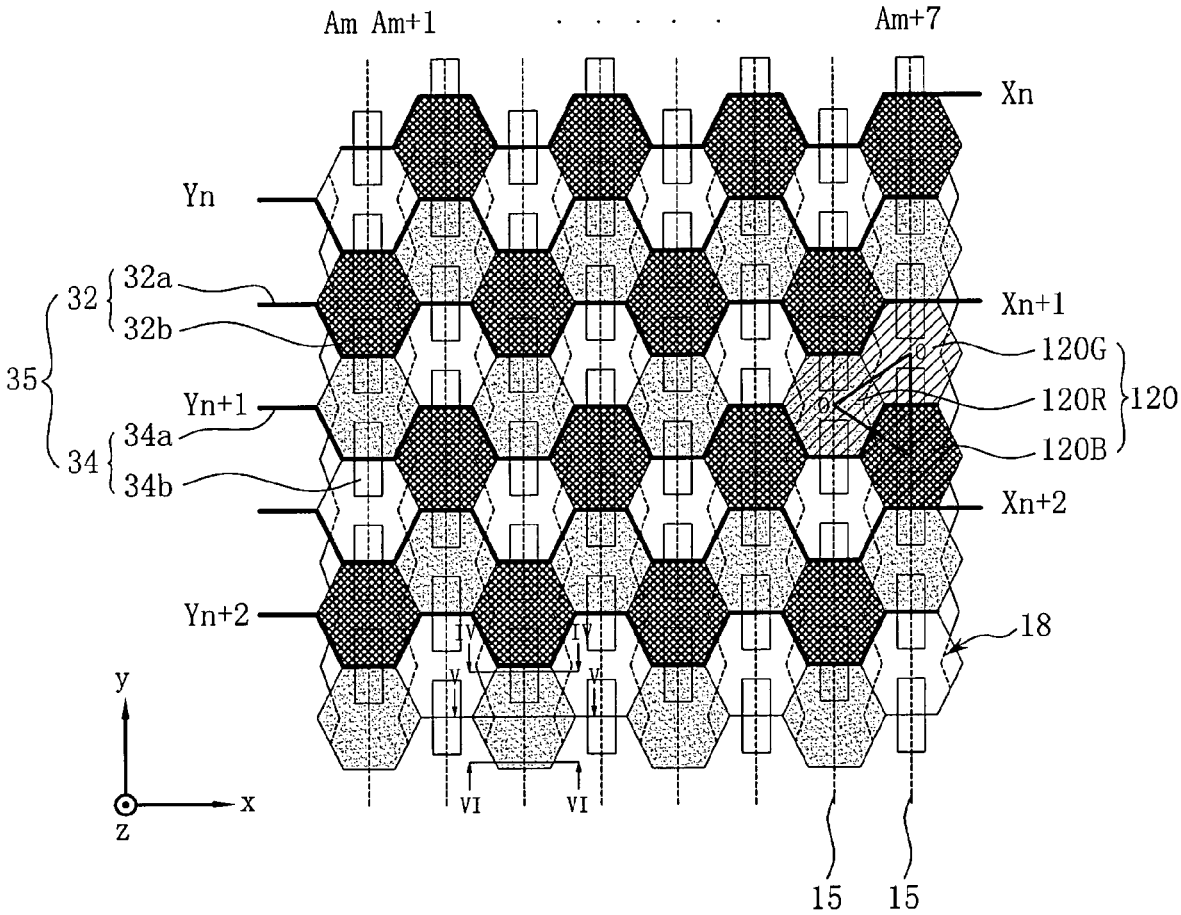
FIG. 2 illustrates a partial top view of pixel units and electrodes arrangement in the PDP of FIG. 1.

An exemplary embodiment of a plasma display device (PDP) according to the present invention is more fully described below with reference to FIGS. 1-2. As illustrated in FIGS. 1-2, a PDP, e.g., a delta-type PDP, according to an embodiment of the present invention may include a rear substrate 10, a front substrate 30, a plurality of pixel units 120, a plurality of address electrodes 15, a plurality of display electrodes 35, and a plurality of barrier ribs 23.

The rear substrate 10 and the front substrate 30 may be formed parallel to one another and at a predetermined distance from one another, such that additional layers, e.g., electrodes, dielectric layers, protective layers, pixel units and so forth, may be formed therebetween, as will be discussed in more detail below.

Each pixel unit 120 of the PDP according to an embodiment of the present invention may include three sub-pixels. In particular, as illustrated in FIG. 2, each pixel unit 120 may include a first sub-pixel 120G emitting green (G) visible light, a second sub-pixel 120R emitting red (R) visible light, and a third sub-pixel 120B emitting blue (B) visible light.

The first, second and third sub-pixels 120G, 120R and 120B of each pixel unit 120 may be arranged in a triangular structure, i.e., connection of center points O of each respective sub-pixel 120R, 120G, and 120B, as illustrated in FIG. 2, may form a triangle, to form the one pixel unit 120. Additionally, each first, second and third sub-pixels 120G, 120R and 120B of each pixel unit 120 may include a discharge cell 18 having a hexagonal plane shape. A discharge gas, e.g., xenon (Xe), neon (Ne), or mixtures thereof, may fill each discharge cell 18.

Each three discharge cells 18 corresponding to one pixel unit 120 may be arranged in two adjacent parallel lines along the y-axis, such that two discharge cells 18 may be formed in one line and one discharge cell 18 may be formed in an adjacent parallel line, as illustrated in FIG. 2. Further, each two adjacent pixel units 120 along the y-axis may have an alternating orientation. In other words, if one pixel unit 120 has two discharging cells 18 in a first line and one discharging cell 18 in a second line, the adjacent pixel unit 120 may have one discharging cell 18 in the first line and two discharging cells 18 in the second line, such that the two adjacent pixel units 120 may form a uniform structure of two parallel lines along the y-axis. Accordingly, an extension of a boundary line between a pair of adjacent discharge cells 18 in the first line, e.g., a boundary extension along the x-axis between two discharge cells 18 of one pixel unit 120, may pass a center of a discharge cell 18 in the second line, e.g., a center O of a third discharge cell 18 of the same pixel unit 120.

In this respect, it should be noted that "lines" may refer to a direction along the y-axis, as illustrated in FIGS. 1-2. This orientation may be parallel to a direction of the address electrodes 15. However, other orientations are not excluded from the scope of the present invention. It should further be noted that terminology such as "first" and "second" with respect to lines is employed to distinguish the lines and indicate their sequence.

The plurality of address electrodes 15 of the PDP according to an embodiment of the present invention may be formed in a stripe-like structure on the rear substrate 10. In particular, the plurality of address electrodes 15 may be parallel to one another and disposed in a direction parallel to the y-axis, as illustrated in FIG. 1. The plurality of address electrodes 15 may be formed such that each pixel unit 120 may overlap with two address electrodes 15, such that at least two of the sub-pixels 120R, 120G, and 120B of each pixel 120 may be driven by one common address electrode 15.

The display electrodes 35 of the PDP according to an embodiment of the present invention may include a plurality of pairs of sustain and scan electrodes 32 and 34, respectively, disposed in a same plane on the front substrate 30 in a direction parallel to the x-axis, as illustrated in FIG. 1. In particular, the plurality of sustain and scan electrodes 32 and 34 may be disposed in an alternating pattern, such that each scan electrode 34 may be positioned between two sustain electrodes 32. The alternating pattern of the sustain and scan electrodes 32 and 34 may provide a discharge gap therebetween, i.e., a discharge cell 18 may be formed therebetween. Accordingly, each discharge cell 18 may be driven by a pair of display electrodes 35 positioned along the x-axis in one plane and an address electrode 15 positioned along the y-axis in another plane, such that application of voltage to the scan electrode 34 and the address electrode 15 may facilitate selection of the discharge cell 18, while application of voltage to the sustain electrode 32 and the scan electrode 34 of the selected discharge cell 18 may facilitate discharge therein.

Each of the sustain and scan electrodes 32 and 34 may include a bus electrode 32*a* and 34*a*, respectively, and a transparent electrode 32*b* and 34*b*, respectively. In particular, each bus electrode 32*a* and 34*a* may be formed of metal and disposed along a corresponding barrier rib 23, i.e., around half a perimeter of each discharge cell 18 in one line. More specifically, as illustrated in FIGS. 1-2, each bus electrode 32*a* and 34*a* may form a zigzag pattern along the x-axis. For example, as illustrated in FIG. 2, the bus electrode 34*a* of a scan electrode $Y_{n+1}$ may have a horizontal structure between the first sub-pixel 120G and the third sub-pixel 120B, a half-hexagonal structure surrounding the second sub-pixel 120R, and so forth. The bus electrodes 32*a* and 34*a* may have reduced widths, i.e., distances as measured along the y-axis, such that the bus electrodes 32*a* and 34*a* may overlap only with the barrier ribs 23 to minimize interference with the emission of visible light from the discharge cells 18.

Each transparent electrode 32*b* and 34*b* may be formed of a transparent material, e.g., indium-tin-oxide (ITO), and be in contact with the bus electrode 32*a* and 34*a*, respectively, such that each transparent electrode 32*b* and 34*b* may extend across the corresponding bus electrode 32*a* and 34*a*, respectively, to overlap with at least two adjacent discharge cells 18 along the y-axis. Accordingly, each discharge cell 18 may overlap with a pair of transparent electrodes 32*b* and 34*b*. In particular, the pair of transparent electrodes 32*b* and 34*b* disposed in a respective discharge cell 18 may be placed across from one another at a predetermined distance, as further illustrated in FIG. 2.

Accordingly, application of voltage to each of the scan electrodes 34 or sustain electrodes 32 may trigger voltage in each respective bus electrode 32*a* and 34*a* and respective transparent electrode 32*b* and 34*b*, such that each display electrode 35 may supply voltage to two adjacent discharge cells 18 positioned along the y-axis, as illustrated in FIG. 2. As such, the alternate arrangement of the scan and sustain electrodes 34 and 32 may control operation of a pair of adjacent discharge cells 18. Accordingly, a configuration of sixteen pixel units 120, i.e., four pixel units in each row and column as illustrated in FIGS. 1-2, may require twelve transparent scan electrodes 34*b* for proper operation of the PDP. Therefore, a ratio of the number of the transparent scan electrodes 34*b* to pixel units 120 according to an embodiment of the present invention may be 3:4, i.e., ¾ of the scan electrodes 34 may correspond to each pixel unit 120.

Similarly, since two address electrodes 15 and ¾ scan electrodes 34 may correspond to each pixel unit 120, i.e., eight address electrodes 15 and three scan electrodes 34 may correspond to the sixteen pixel units 120 illustrated in FIG. 2, the number of the address electrodes 15 and the number of the scan electrodes 34 may satisfy the relationship NA:NS=8:3, wherein NA is the number of address electrodes and NS is the number of scan electrodes.

Since only eight address electrodes 15 may be required to drive sixteen pixel units 120 in the PDP of the present embodiment, as compared to twelve address electrodes required in a comparable conventional PDP, i.e., a PDP having sixteen pixel units, the PDP of the present embodiment exhibits a reduced number of address electrodes, while maintaining the same number of pixel units 120.

The barrier ribs 23 of the PDP according to an embodiment of the present invention may be disposed between the rear and front substrates 10 and 30 to separate the pixel units 120 and to define the discharge cells 18 therein. In particular, the barrier ribs 23 of the present invention will be described in more detail with respect to FIGS. 3-6 below.

The barrier ribs 23 may be formed of a mixture paste containing a main material, a volatile solvent, an additive agent, and a binder by any method known in the art, e.g., sandblasting process, etching process, and so forth. Subsequently, the mixture paste may be deposited on the rear substrate 10 in hourglass-like structures, as illustrated by the solid line in FIG. 3, to form sidewalls of the barrier ribs 23 along the direction of the y-axis in order to define respective discharge cells 18, i.e., each hourglass structure may correspond to one discharge cell 18. In particular, each hourglass structure may be formed to have a first center width d3 and a first edge width d4, such that the first center width d3 may be smaller than the first edge width d4, as further illustrated in FIG. 3.

Figure 3:
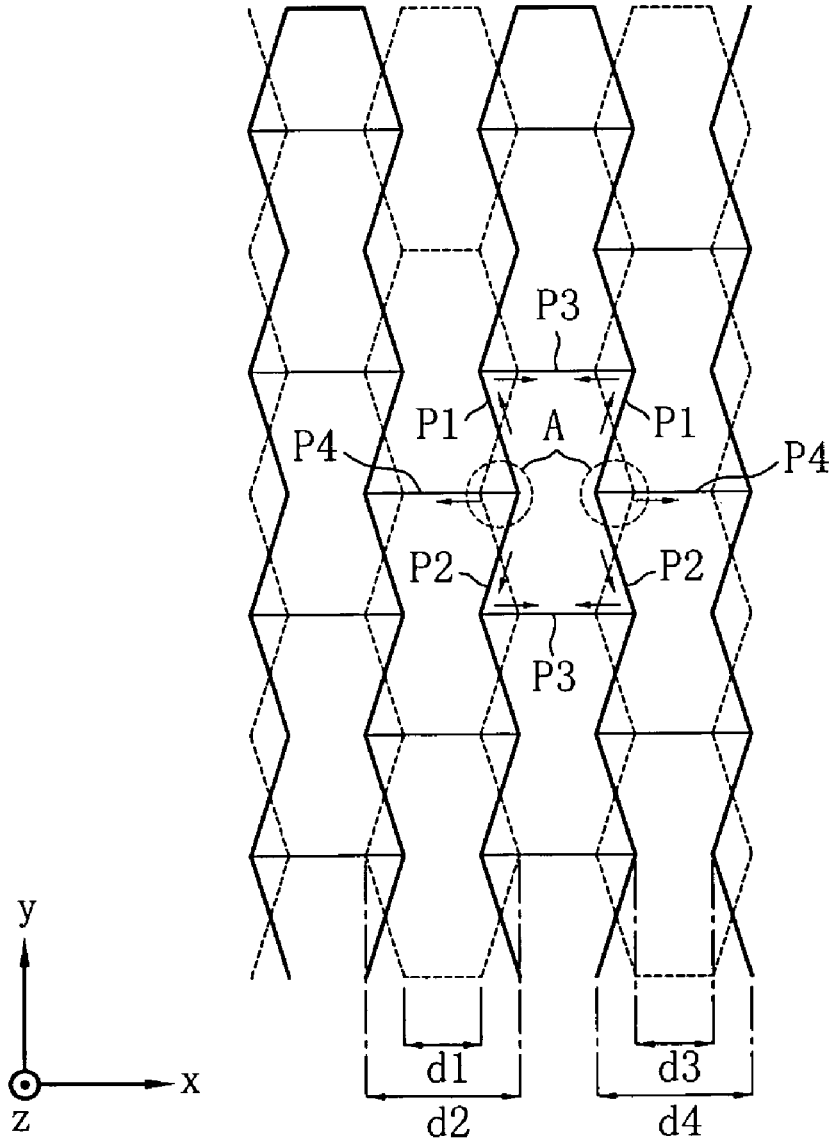
FIG. 3 illustrates a view of barrier ribs structure illustrated in FIGS. 1-2 and fabrication thereof.

Next, the hourglass-like structures may be baked in a baking furnace, such that the mixture paste may contract as the volatile solvent is vaporized. The contraction of the mixture paste along a direction of the x-axis may be greater than its contraction along the y-axis. In particular, as illustrated in FIG. 3, portions p4 may contract along a direction illustrated by the arrows, thereby triggering contraction of portions p3, as further illustrated by the arrows. Contraction of the portions p3 and p4 may trigger contraction of portions p1 and p2 toward the portion p3, such that center portions of the hourglass structures may expand, e.g., portion A may expand along the x-axis, and transform to have a hexagonal plane shape, as illustrated by the dotted line in FIG. 3.

However, it should be noted that the contraction and expansion of the barrier ribs 23 structures may occur mainly at upper portions thereof because lower portions of the barrier ribs 23 may be fixed to the rear substrate 10. Accordingly, a bottom portion of each discharge cell 18 may have the first central and edge widths d3 and d4, while an upper portion of each discharge cell 18 may have a second central width d2 and a second edge width d1, wherein the second central width d2 may be greater than the second edge width d1. In other words, the upper portion of each discharge cell 18 may expand to have a hexagonal plane shape, while the bottom portion of each discharge cell 18 may hardly change, i.e., portions p1 and p2 that correspond to edges of each discharge cell 18 may hardly be affected by the contraction during baking.

Figure 4:
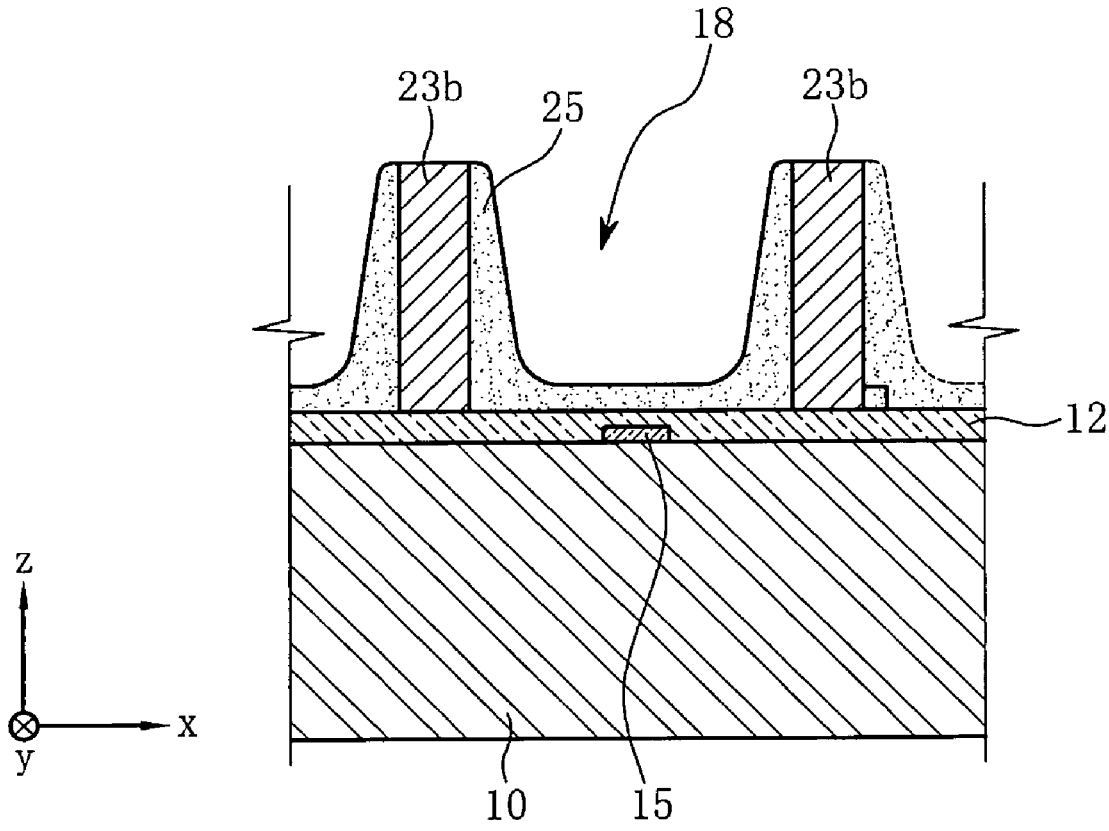
FIG. 4 illustrates a sectional view taken along line IV-IV of FIG. 2.
Figure 5:
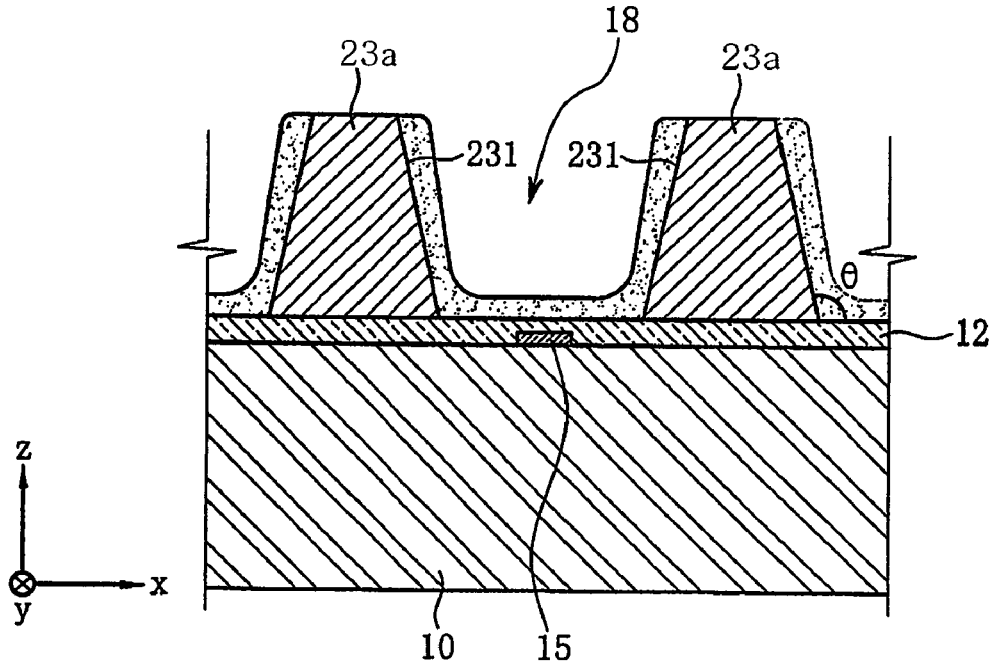
FIG. 5 illustrates a sectional view taken along line V-V of FIG. 2.
Figure 6:
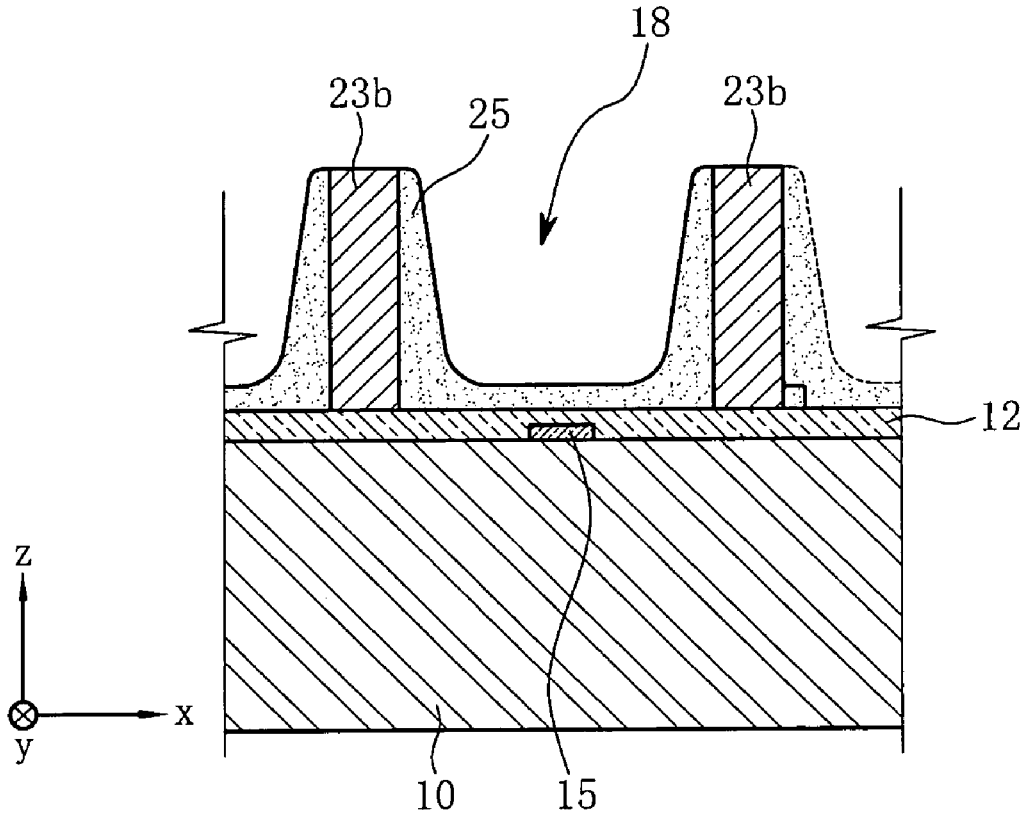
FIG. 6 illustrates a sectional view taken along line VI-VI of FIG. 2.

Therefore, each barrier rib 23 may include a first longitudinal portion 23*a* and a second longitudinal portion 23*b*, as illustrated in FIG. 4-6. In particular, the first longitudinal portion 23*a* may correspond to a sidewall of the barrier rib 23 that is adjacent to the center of a respective discharge cell 18, and the second longitudinal portion 23*b* may correspond to a sidewall of the barrier rib 23 that is adjacent to the edge of the respective discharge cell 18. Further, the first longitudinal portion 23*a* may have a trapezoidal cross-section, such that an outer surface 231 of the first longitudinal portion 23*a* may form an obtuse angle θ with a bottom of the discharge cell 18, as illustrated in FIG. 5, due the expansion of an upper portion thereof during baking. On the other hand, the second longitudinal portion 23*b* may have a rectangular or inverted trapezoidal cross-section that may form a straight or an acute angle with a bottom of the discharge cell 18, as illustrated in FIGS. 4 and 6, due to its minor structural changes during baking.

Without intending to be bound by theory, it is believed that the above-described barrier ribs 23 may be advantageous in providing increased discharge volumetric space in highly integrated structures. In particular, since the upper portion of each discharge cell 18 may be expanded during baking, the overall volume in the discharge cell 18 may be increased. Further, the inclined sidewalls of a center part of each discharge cell 18, i.e., first longitudinal portions 23*a* forming an obtuse angle with the rear substrate 10, may provide increased deposition area for phosphorescent material, thereby increasing color and luminance efficiency.

The PDP according to an embodiment of the present invention may further include phosphorescent layers 25. Each phosphorescent layer 25 may be applied to a respective red, green, and blue sub-pixel 120R, 120G, and 120B to emit a respective red, green, and blue light. In particular, each phosphorescent layer 25 may be applied to a bottom surface of each discharge cell 18 and a sidewall of a barrier rib 23, such that two adjacent sub-pixel may emit different colors.

Additionally, the PDP according to an embodiment of the present invention may also include a first dielectric layer 12. The first dielectric layer 12 may be formed between the rear substrate 10 and the barrier ribs 23. In particular, the address electrodes 15 may be positioned between the rear substrate 10 and the first dielectric layer 12, such that the address electrodes 15 may be separated from the barrier ribs 23. The PDP according to an embodiment of the present invention may also include a second dielectric layer (not shown) deposited on the front substrate 30 to separate the display electrodes 35 from the barrier ribs 23 and a passivation layer (not shown) formed of magnesium-oxide (MgO) on the second dielectric layer.

Figure 7:
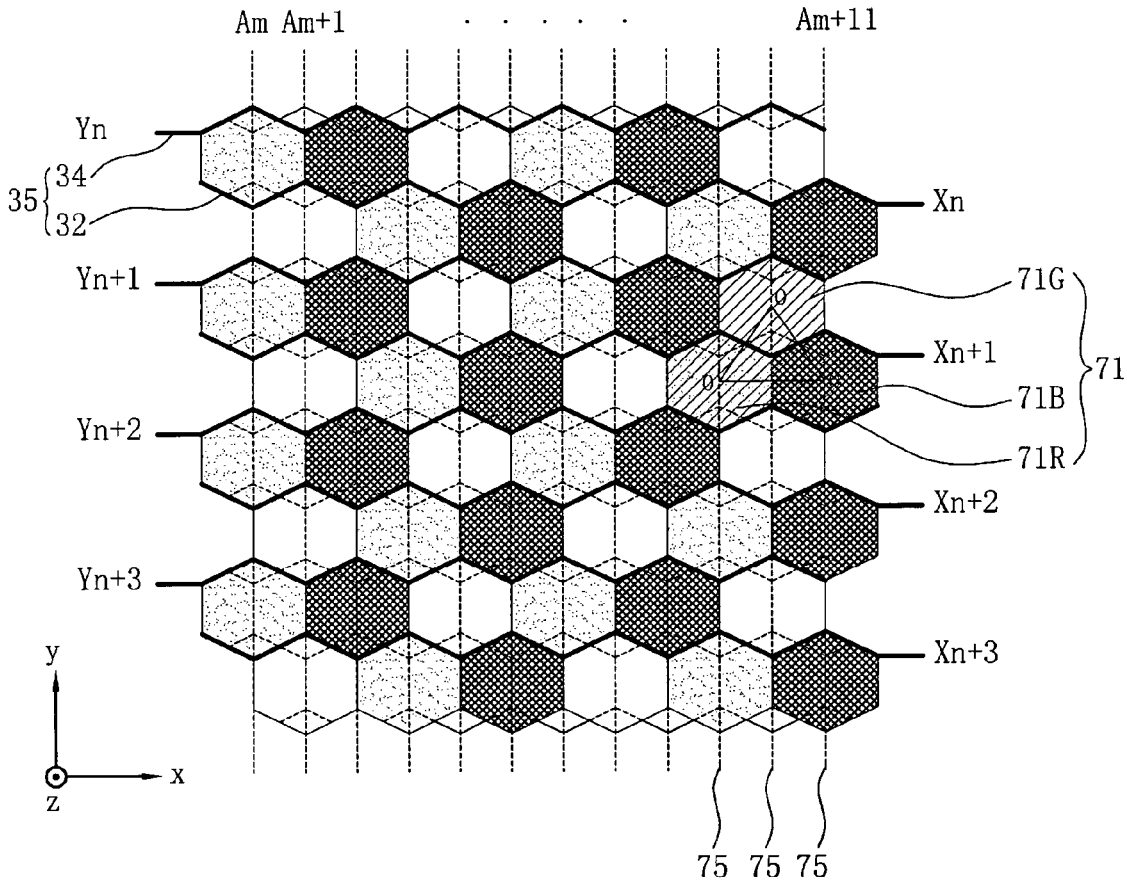
FIG. 7 illustrates a partial top view of pixel units and electrodes arrangement of a PDP according to another embodiment of the present invention.

In another embodiment of the present invention, as illustrated in FIG. 7, a PDP may be similar to the PDP described with respect to FIG. 1, with the exception that each of the plurality of pixel units 71 therein may be arranged to have each of first, second and third sub-pixels 71G, 71R and 71B emit a different color of visible light and positioned to form a color array in each line along the x-axis. In other words, each unit pixel 71 may be arranged such that respective sub-pixels emitting a same color of visible light may be positioned in a same line along the x-axis. For example, a first column of pixel units 71 may be arranged such that each pixel unit 71 may have a sub-pixel 71B positioned as a right-most sub-pixel, thereby forming a column of blue light-emitting sub-pixels 71B. Accordingly, color arrays of identical light-emitting sub-pixels may be formed and arranged in an alternating pattern, e.g., blue light-emitting column, green light-emitting column, red light-emitting column, and so forth. It should be noted that a corresponding phosphorescent layer, i.e., corresponding color of light-emitting layer, may be applied to each such column.

The color array arrangement of the present embodiment may provide a structure, such that each color array may overlap with one address electrode 75, i.e., each column of sub-pixels may overlap with one address electrode 75 that may be positioned in a direction parallel to the x-axis. However, it should be noted that in the embodiment described with respect to FIG. 7 the barrier ribs 23 may be formed in a direction parallel to the direction of the display electrodes 35, i.e., perpendicularly to the address electrode 75.

The structure of the PDP described with respect to FIG. 7 exhibits the same advantages with respect to improved barrier rib 23 structure and increased discharge space and efficiency as the PDP described with respect to FIGS. 1-6.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A plasma display panel, comprising:

a front substrate;

a rear substrate positioned in parallel to the front substrate;

a plurality of address electrodes between the front and rear substrates;

a plurality of display electrodes positioned perpendicularly to the plurality of address electrodes; and a plurality of barrier ribs between the front and rear substrates defining sidewalls of a plurality of discharge cells, at least one longitudinal sidewall in each discharge cell including first and second portions, the first portion of the longitudinal sidewall defining an obtuse angle with respect to the rear substrate, and the second portion of the longitudinal sidewall defining a non-obtuse angle with respect to the rear substrate, wherein each discharge cell has a first center width and a first edge width, the first center width being smaller than the first edge width, the first center width crossing a center of the discharge cell along a first direction in a bottom portion of the discharge cell, and the first edge width extending along the first direction in the bottom portion of the discharge cell and being spaced apart from the first center width, and wherein each discharge cell has a second center width and a second edge width, the second center width being greater than the second edge width, the second center width crossing a center of the discharge cell along the first direction in a top portion of the discharge cell, and the second edge width extending along the first direction in the top portion of the discharge cell and being spaced apart from the second center width.

2. The plasma display panel as claimed in claim 1, wherein the longitudinal sidewalls of the discharge cells extend along a direction substantially parallel to a direction of the plurality of address electrodes.

3. The plasma display panel as claimed in claim 2, wherein the display electrodes include pairs of scan and sustain electrodes, and a ratio of the address electrodes to the scan electrodes is about 8:3.

4. The plasma display panel as claimed in claim 2, wherein each three discharge cells of the plurality of discharge cells are arranged in a triangular shape and form one pixel unit.

5. The plasma display panel as claimed in claim 4, wherein two of the three discharge cells are adjacent to one another along a direction parallel to the direction of the address electrodes, the adjacent discharge cells sharing a sidewall therebetween.

6. The plasma display panel as claimed in claim 5, wherein the two adjacent discharge cells overlap with one common address electrode.

7. The plasma display panel as claimed in claim 5, wherein an extension line of a boundary between the two adjacent discharge cells passes a center of a third discharge cell of the three discharge cells.

8. The plasma display panel as claimed in claim 4, wherein each discharge cell of the three discharge cells emits a different color of light.

9. The plasma display panel as claimed in claim 1, wherein the sidewalls in each discharge cell are arranged in a hexagonal plane shape to define a hexagonal discharge cell, at least one sidewall of six sidewalls in each hexagonal discharge cell includes both the first and second portions.

10. The plasma display panel as claimed in claim 1, wherein the longitudinal sidewalls of the discharge cells extend along a direction substantially perpendicular to a direction of the plurality of address electrodes.

11. The plasma display panel as claimed in claim 10, wherein three discharge cells of the plurality of discharge cells are arranged in a triangular shape to form one pixel unit, and two of the three discharge cells are adjacent to one another along a direction perpendicular to the direction of the address electrodes.

12. The plasma display panel as claimed in claim 11, wherein each discharge cell of the three discharge cells emits a different color of light.

13. The plasma display panel as claimed in claim 12, wherein each pixel unit is positioned to form a color array.

14. The plasma display panel as claimed in claim 13, wherein each color array overlaps with one address electrode.

15. The plasma display panel as claimed in claim 1, wherein at least two longitudinal sidewalls in each discharge cell extend along a substantially same direction, the at least two longitudinal sidewalls directly contacting each other via respective first portions thereof.

16. The plasma display panel as claimed in claim 1, wherein a cross section of the first portion along a first plane has a different geometric shape than a cross section of the second portion along a second plane, the first and second planes being substantially parallel.

17. The plasma display panel as claimed in claim 1, wherein the first and second portions of the at least one longitudinal sidewall are facing a substantially same direction, the first and second portions being integral with each other to define a single sidewall along a single linear direction.

18. The plasma display panel as claimed in claim 17, wherein the obtuse angle of the first portion gradually decreases along the single linear direction to become non-obtuse.

* * * * *